US007679000B2

(12) United States Patent
Rauckman

(10) Patent No.: US 7,679,000 B2
(45) Date of Patent: Mar. 16, 2010

(54) WILDLIFE GUARD WITH OVERMOLDED CONDUCTIVE MATERIAL

(76) Inventor: James B. Rauckman, 37 Ednick Dr., Swansea, IL (US) 62226

( * ) Notice: Subject to any disclaimer, the term of this patent is extended or adjusted under 35 U.S.C. 154(b) by 225 days.

(21) Appl. No.: 11/703,471

(22) Filed: Feb. 7, 2007

(65) Prior Publication Data

US 2007/0131447 A1 Jun. 14, 2007

Related U.S. Application Data

(60) Continuation-in-part of application No. 11/521,425, filed on Sep. 14, 2006, now Pat. No. 7,309,837, which is a division of application No. 11/450,081, filed on Jun. 9, 2006, now Pat. No. 7,276,665, which is a division of application No. 11/077,917, filed on Mar. 11, 2005, now Pat. No. 7,075,015, which is a division of application No. 10/664,231, filed on Sep. 17, 2003, now Pat. No. 6,878,883.

(51) Int. Cl.
*H01B 7/04* (2006.01)

(52) U.S. Cl. ..... 174/135; 174/5 R; 174/138 F; 361/232; 52/101; 49/59

(58) Field of Classification Search ..... 174/135, 174/151, 17 CT, 31 R, 162, 137 R, 136, 138 R, 174/161 F, 138 F, 5 R, 140 R, 3, 141 R, 144, 174/139, 5 SB, 5 SG, 152 G, 153 G, 152 R; 361/604, 618, 232; 49/58, 549; 52/101; D13/118; 340/584

See application file for complete search history.

(56) References Cited

U.S. PATENT DOCUMENTS

| | | | |
|---|---|---|---|
| 422,651 | A | 3/1890 | Stanley |
| 1,376,202 | A | 4/1921 | Hart |
| 1,486,417 | A | 3/1924 | Cheely |
| 1,641,081 | A | 8/1927 | Heymann |
| 1,766,636 | A | 6/1930 | Holzel |
| 2,099,540 | A | 11/1937 | Smith |
| 2,234,391 | A | 3/1941 | Taylor |

(Continued)

FOREIGN PATENT DOCUMENTS

| | | | |
|---|---|---|---|
| DE | 3528771 | A1 | 2/1987 |

(Continued)

OTHER PUBLICATIONS

High Polymers, Copyright © 1964 by John Wiley & Sons, Inc., Library of Congress Catalog Card No. 62-18932 (4 pages).

(Continued)

*Primary Examiner*—Angel R Estrada
(74) *Attorney, Agent, or Firm*—Polster Lieder Woodruff & Lucchessi LC

(57) ABSTRACT

A wildlife guard for electrical power equipment including a body constructed to mount onto the equipment. The body has an electrically conductive layer thereon. The electrically conductive layer comprises an electrically insulating material with a conductive filler material in quantity sufficient for the guard to maintain an electrostatic charge. The electrically conductive layer is bonded to the body by over-molding or co-molding techniques. The electrically conductive layer can be continuous or can be discrete segments separated by non-conductive segments. The body can be constructed from a conductive or non-conductive material.

54 Claims, 9 Drawing Sheets

U.S. PATENT DOCUMENTS

| | | | |
|---|---|---|---|
| 2,421,151 | A | 5/1947 | Johnstone |
| 2,459,060 | A | 1/1949 | Bush |
| 2,483,874 | A | 10/1949 | Bernhard |
| 2,488,466 | A | 11/1949 | Carver |
| 2,493,107 | A | 1/1950 | Bush |
| 2,513,141 | A | 6/1950 | Carder et al. |
| 2,617,378 | A | 11/1952 | Osol |
| 2,840,631 | A | 6/1958 | Marcroft |
| 2,999,378 | A | 9/1961 | Carter |
| 2,999,479 | A | 9/1961 | Carder |
| 3,005,436 | A | 10/1961 | Caldwell |
| 3,016,034 | A | 1/1962 | Raistakka |
| 3,056,375 | A | 10/1962 | Bernhard |
| 3,056,376 | A | 10/1962 | Bender |
| 3,192,311 | A | 6/1965 | Weinfurt |
| 3,194,203 | A | 7/1965 | Thornton |
| 3,366,854 | A | 1/1968 | Robinson |
| 3,410,936 | A | 11/1968 | Juras |
| 3,753,416 | A | 8/1973 | Haglund et al. |
| 3,872,818 | A | 3/1975 | Salvarezza |
| 4,053,707 | A | 10/1977 | Ely et al. |
| 4,110,943 | A | 9/1978 | Carlson |
| 4,110,944 | A | 9/1978 | Carlson |
| 4,159,395 | A | 6/1979 | Cogelia |
| 4,201,883 | A | 5/1980 | Shepherd |
| 4,243,628 | A | 1/1981 | Herold |
| 4,359,844 | A | 11/1982 | Hoggard et al. |
| 4,465,263 | A | 8/1984 | Robbins, Jr. |
| 4,467,387 | A | 8/1984 | Bergh et al. |
| 4,500,595 | A | 2/1985 | Gerteisen et al. |
| 4,535,197 | A | 8/1985 | Butler |
| 4,570,564 | A | 2/1986 | Salvarezza |
| 4,636,408 | A | 1/1987 | Anthony et al. |
| 4,637,164 | A | 1/1987 | Brown |
| 4,664,971 | A | 5/1987 | Soens |
| 4,707,562 | A | 11/1987 | Whited |
| 4,731,507 | A | 3/1988 | Torimoto et al. |
| 4,755,633 | A | 7/1988 | Standing |
| 4,788,633 | A | 11/1988 | Zimermann et al. |
| 4,803,819 | A | 2/1989 | Kelsey |
| 4,804,717 | A | 2/1989 | Ramey et al. |
| 4,845,307 | A | 7/1989 | Cumming et al. |
| 4,860,996 | A | 8/1989 | Robbins, III |
| 4,906,801 | A | 3/1990 | Beasley |
| 4,973,029 | A | 11/1990 | Robbins, III |
| 5,008,148 | A | 4/1991 | Thurm et al. |
| 5,115,104 | A | 5/1992 | Bunyan |
| 5,170,750 | A | 12/1992 | Ricketts |
| 5,293,721 | A | 3/1994 | Richard et al. |
| 5,293,835 | A | 3/1994 | Shagoury |
| 5,299,528 | A | 4/1994 | Blankenship |
| 5,326,947 | A | 7/1994 | Edds et al. |
| 5,347,769 | A | 9/1994 | Dinsmore |
| 5,359,313 | A | 10/1994 | Watanabe et al. |
| 5,437,749 | A | 8/1995 | Pipkorn et al. |
| 5,446,242 | A | 8/1995 | Barrett |
| 5,525,073 | A | 6/1996 | Sampson |
| 5,570,652 | A | 11/1996 | Ferland |
| 5,644,641 | A | 7/1997 | Ikeda |
| 5,648,641 | A | 7/1997 | Guthrie |
| 5,650,594 | A | 7/1997 | Urnovitz |
| 5,679,922 | A | 10/1997 | Harben |
| 5,682,015 | A | 10/1997 | Harben |
| 5,794,495 | A | 8/1998 | Anderson |
| 5,834,686 | A | 11/1998 | Barrett et al. |
| 5,864,096 | A | 1/1999 | Williams et al. |
| 5,873,324 | A | 2/1999 | Kaddas et al. |
| 5,884,426 | A | 3/1999 | Ishida |
| 6,005,196 | A | 12/1999 | Spillyards |
| D432,742 | S | 10/2000 | Puigcerver et al. |
| 6,161,289 | A | 12/2000 | Alexander |
| 6,248,956 | B1 | 6/2001 | Cook et al. |
| 6,250,023 | B1 | 6/2001 | Donoho |
| 6,255,597 | B1 | 7/2001 | Bowling et al. |
| 6,291,774 | B1 | 9/2001 | Williams |
| 6,314,914 | B1 | 11/2001 | Betzen |
| 6,382,611 | B1 | 5/2002 | Ramer |
| 6,453,775 | B1 | 9/2002 | Dietric et al. |
| 6,533,881 | B1 | 3/2003 | Wall |
| 6,571,517 | B2 | 6/2003 | Wulff et al. |
| 6,668,458 | B1 | 12/2003 | Schoenleber |
| 6,683,249 | B1 | 1/2004 | Leppin |
| 6,878,883 | B1 | 4/2005 | Rauckman |
| 7,075,015 | B1 | 7/2006 | Rauckman |
| 7,276,665 | B1 * | 10/2007 | Rauckman ..... 174/135 |
| 7,309,837 | B1 * | 12/2007 | Rauckman ..... 174/138 F |
| 2002/0175000 | A1 | 11/2002 | Wright |
| 2003/0015330 | A1 | 1/2003 | Wood et al. |
| 2003/0046882 | A1 | 3/2003 | Homer et al. |
| 2003/0140735 | A1 | 7/2003 | Weaver et al. |
| 2004/0221456 | A1 | 11/2004 | Losinger |
| 2005/0034884 | A1 | 2/2005 | Lee |

FOREIGN PATENT DOCUMENTS

| | | | |
|---|---|---|---|
| EP | 328365 | A2 | 8/1989 |
| FR | 2307352 | | 4/1976 |
| GB | 28561 | | 9/1911 |
| GB | 22304 | | 7/1912 |
| GB | 185041 | | 8/1922 |
| GB | 296535 | | 9/1928 |
| GB | 1303432 | | 1/1973 |
| GB | 1337951 | | 11/1973 |
| GB | 1337952 | | 11/1973 |
| GB | 1542845 | | 3/1979 |
| GB | 2264622 | A | 8/1993 |
| JP | 9369302 | | 1/1993 |
| SU | 761351 | | 7/1980 |
| WO | 9208237 | | 5/1992 |
| WO | 9616416 | | 5/1996 |

OTHER PUBLICATIONS

Homac Mfg. Company, Quality Electrical Connectors and Accessories, "Wildlife Protectors" p. 127 (2 pages).

Chubu Electrical Power Co., Inc. Application No. 63-116496, "Bird Damage Preventing Device" Kazuhiko, Okabe (1 page).

Modern Plastics Encyclopedia, 1968-1969, Ultraviolet Absorbers by S. B. Miller and G.R. Lappin and C.E. Tholstrup/Eastman Chemical Products, Inc., 1969, pp. 442-446.

Cooper Power Systems equipment brochure No. K-SEC 183, "Hi-Line Cover-Up Equipment" pp. 1-17, dated Mar. 1998.

3M corporation publicity release date-lined Austin,Texas—Apr. 16, 1998: "3M Electrostatic Animal Guard Humanely Keeps Animals Off Insulators & Bushings".

Hubbell/Chance Power Systems, Inc., catalog p. 2403 "Conductor and Insulator Covers" and p. 2408 "Crossarm Cover and Conductor and Insulator Covers" dated Jan. 2002.

Wall Street Journal article dated Feb. 4, 2003: "Fried Squirrel Fails to Find Favor With Public Utilities . . . as Electrocuted Critters Cause Power Outages".

Internet pages printed Sep. 11, 2003 from www.critterguard.org: "Reliability demands the only true barrier! " (3 pages total, 2 of which are essentially blank).

3M brochure No. 78-8121-1101-7 Instruction Sheet, © 1998: "Electrostatic Animal Guard (Formerly the Guthrie Guard)" (4 sheets total).

Page 325 (undated) of 3M Cable Accessory Products catalog: "Electrostatic Animal Guard" The Squirrely brochure, dated 1986 (1 page).

PLP Preformed Line Products, Section 18—Distribution (Overhead): Wildlife Protection, Sections 18-1 thru 18-5.

IEEE Std 1264-1993, IEEE Guide for Animal Deterrents for Electric Power Supply Substations, Approved Mar. 18, 1993, Copyright © 1993 by the Institute of Electrical and Electronics Engineers, Inc., ISBN 1-55937-304-0.

Chubu Electric Power Co., Inc , Bird Damage Preventive Device for Suspension Insulator Power Transmisison Line, Pub. No. 05-012943, Published Jan. 22, 1993, Chubu Electric Power Co., Inc.
M&T Chemicals Inc., From M&T Chemicals Inc.: Vinyl stabilizers, Synthietic fiber additivies, Flame retarders, Urethane foan additives. And Anti-microbials. "Thermolite* Vinyl Stabilizers".
IEEE Standards Quarterly Status Report (Numerical), Wednesday, Jan. 3, 1996; IEEE Guide for Animal Deterrents for Electric Power Supply Substations, Institute of Electrical and Electronics Engineers, Service Center, Piscataway, NJ.
MIDSUN Group, Southington, Connecticut, E/BARRIER™ Common Applications, Product Description, and Instructions E/BARRIER™ , http://www.midsungroup.com.
Electrical World, vol. 199, No. 1, Jan. 1985, Utility Methods, "Joint effort yields new barrier design," Michael G. McGraw, pp. 85 and 86.
Critter Guard. "Critter Guard History", Douglas Wulff, Critter Guard, Inc., http://www.critterguard.org/about.htm.
Gary Guard, "A Revolutionary New Approach to Live Line Maintenance", Tools for Live Line Work, Gary Guard, Inc.
The Squirrely, "Squirrel and Bird Guard for Secondary Transformer Bushings", H.J. Arnett Industries, L.L.C.—Innovative Instruments for Utilities & Industry, Portland, Oregon, www.arnettindustries.com.
Varmint Shield,—16" Diameter for Distribution Application, Catalog #USVS-001 (patent pending), http://www.utilitysolutionsinc.com/varmint/wildlifeweb.htm.
Office communication concerning Co-Pending U.S. Appl. No. 11/450,081, filed Jun. 9, 2006.

* cited by examiner

WILDLIFE GUARD WITH OVERMOLDED CONDUCTIVE MATERIAL

CROSS REFERENCE TO RELATED APPLICATIONS

This application is a continuation-in-part of application Ser. No. 11/521,425, filed Sep. 14, 2006, now U.S. Pat. No. 7,309,837, which is a division of application Ser. No. 11/450,081, filed Jun. 9, 2006, now U.S. Pat. No. 7,276,665, which is a division of application Ser. No. 11/077,917, filed Mar. 11, 2005, now U.S. Pat. No. 7,075,015, which is a division of application Ser. No. 10/664,231, filed Sep. 17, 2003, now U.S. Pat. No. 6,878,883, all of which are incorporated herein by reference.

FIELD OF THE INVENTION

The present invention relates to a wildlife guard for electrical power distribution and substation facilities. More particularly, it relates to a wildlife guard comprising an electrically conductive material that is capable of maintaining a small electrostatic charge that provides an annoying shock to deter wildlife from climbing thereon.

BACKGROUND OF THE INVENTION

Distribution and substation equipment used to supply electrical power have used wildlife protection to prevent wildlife from simultaneously contacting energized and grounded surfaces or adjacent phases. When such contact occurs, short circuits and consequent power outages frequently are the result. The wildlife protection is typically applied to an equipment bushing or lightning arrester of the distribution or substation equipment. For adequate protection, a number of presently available wildlife guards have also required an insulated or covered wire interconnecting apparatus on the substation and distribution system.

Available wildlife guards have posed problems because they only attempt to deter the animal from simultaneously touching a grounded surface and an energized surface by functioning as a barrier, for example. The guards do nothing to keep the animal from climbing on the equipment entirely. As a result, because the animal is not deterred from staying away from the equipment entirely, the animal may still find a way to simultaneously touch energized and grounded surfaces or may cause the wildlife guard to be move or removed from the protected device. Additionally, the animals, particularly squirrels, have a tendency to chew on prior art wildlife guards. As a result there is a need for a wildlife guard that prevents or deters animals from climbing upon energized equipment.

SUMMARY OF THE INVENTION

In one aspect the present invention provides a wildlife guard for electrical power equipment comprising a body disposed for fitting onto the equipment. The body comprises a frame and with an electrically conductive material molded onto the frame. The frame can be of any desired configuration such as a disc, a cone, a grid, a grill, a plate, a tube or so forth.

In one aspect of the invention the electrically conductive material can be applied to a insulating structure for use with electrical equipment.

In one aspect of the invention the electrically conductive material comprises dielectric material with a conductive filler material in quantity sufficient to maintain an electrostatic charge.

In one aspect of the invention, the electrically conductive material is molded on the frame in a continuous pattern and in another aspect of the invention the electrically conductive material is molded on the frame in segments at discrete intervals so that the electricity will not pass through the wildlife guard to an installer if the wildlife guard inadvertently contacts a conductive part of the equipment and ground at the same time.

The electrically conductive material can be molded on the frame using over molding techniques including injection molding, cavity molding, compression molding extrusion molding and even dip molding.

DESCRIPTION OF THE PREFERRED EMBODIMENT

Figure 1:
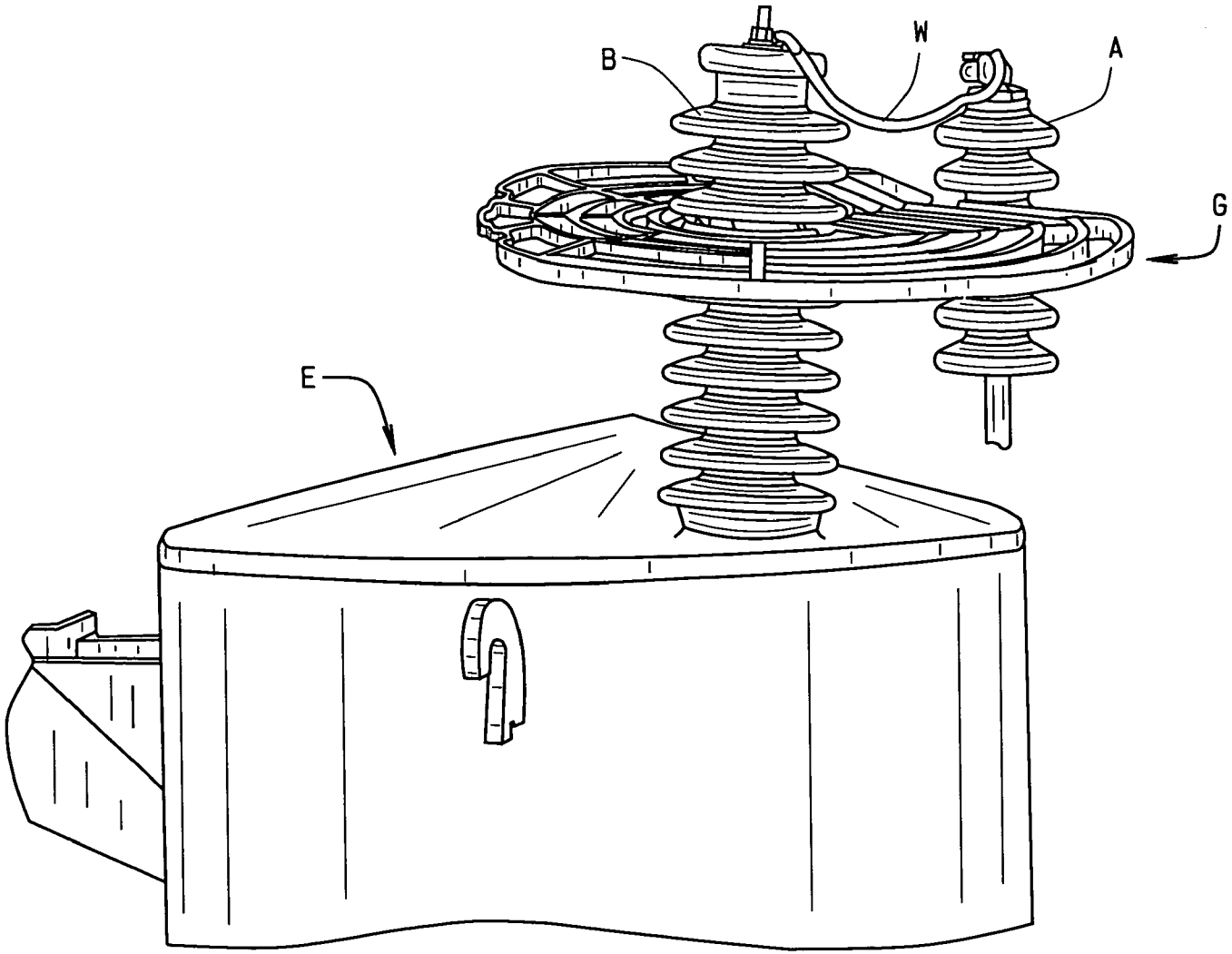
FIG. 1 is an isometric view of a wildlife guard of the present invention mounted on electrical power distribution equipment.

While the invention may be embodied in many different forms, there is described in detail illustrative embodiments of the invention. It is to be understood that the present disclosure is to be considered only as an example of the principles of the invention. This disclosure is not intended to limit the broad aspect of the invention to the illustrated embodiments nor is the disclosure intended to limit the scope of the appended claims.

In general, the wildlife guard of the present invention comprises a body, which may also be referred to as a frame depending upon the overall configuration, configured and disposed for convenient mounting on electrical equipment to deter an animal from contacting an energized part of the electrical equipment and a grounded structure at the same time. In one aspect of the invention the frame is constructed from a non-conductive material, such a thermoplastic or thermosetting resin, other thermoplastic polymers, rubber, fiberglass or the like. In other aspects of the invention, the frame can be formed from metal or wire or similar material that may be conductive. In any event, the wildlife guard includes an electrically conductive layer on the frame. In general, the electrically conductive layer comprises a dielectric material with an electrically conductive filler.

The dielectric material comprises a moldable dielectric material such as thermoplastic elastomers, thermoplastic polymers, thermoplastic resins, rubber, such as copolymer rubbers, or other appropriate compounds or mixtures of the foregoing. The conductive filler is dispersed in the moldable dielectric material. The conductive filler can be any conductive material such as stainless steel, aluminum, copper, carbon black and so forth. The conductive layer includes sufficient conductive filler so that when a layer is molded on the frame and the frame is mounted on the electrical equipment, the dispersed conductive filler functions like an array of capacitors sufficient to hold an electrostatic charge. When an animal, such as a squirrel, contacts the electrically conductive layer, there is a discharge of electricity sufficient to shock and deter the animal without killing the animal.

In one aspect of the invention, the entire surface of the frame may have an electrically conductive layer. In other aspects of the invention, only the most highly exposed or most accessible surfaces of the frame include an electrically conductive layer. In other aspects of the invention, the frame includes discrete segments or areas of electrically conductive layer. The conductive layer can completely encapsulate the frame or be on a top surface, side surface, edge or any other exposed surface of the frame electrically conductive material thereon in a quantity sufficient to form an array of capacitors on the frame such that the wildlife guard maintains an electrostatic charge when placed on electrical equipment.

When the conductive layer is present in segments, the segments generally are separated by sections or areas of non-conductive material, which can be exposed non-conductive frame or layer of non-conductive material molded on the frame such that the electrically conductive segments or areas or not in electrical contact with each other. With this construction, electrical current would not pass through the entire wildlife guard if it inadvertently contacts electrically conductive equipment and ground at the same time, or any two points possessing a difference in electrical potential. In other embodiments, the discrete segments could be applied to a conductive frame, such as a wire frame.

In other aspects of the invention a conductive layer can be applied directly to an insulating device employed with electrical distribution equipment.

The wildlife guard of the present invention may be configured as a disc, a plate, a cone, a tube, a grid, a grill, lattice or any other desirable configuration that is attachable to the electrical distribution equipment.

In one aspect of the invention, the electrically conductive layer is over molded on the frame using known over-molding or co-molding techniques, such as cavity, injection or compression molding.

In one representative embodiment, the frame comprises a thermoplastic resin and the conductive layer comprises a thermoplastic elastomer with conductive filler dispersed therein. Generally, both the frame material and the conductive material may be formulated to be resistant to deterioration by ultra-violet radiation and exposure to the weather.

In another representative embodiment, the frame comprises metal or wire or other similar material that may be conductive and the conductive layer comprises a thermoplastic elastomer with conductive filler dispersed therein.

In general, there is a permanent bond between the conductive layer and a non-conductive frame. Such a direct bond may be achieved as a result of a co-molding process in which both materials are at least semi-flowable and thus may bond to each other. The frame and the conductive layer can be formed by a two-shot or two-step two material injection molding process in which the materials from which the frame and the conductive layer are formed are injected, either simultaneously or consecutively, into the mold in which the wildlife guard is to be formed. The mold cavities for forming the conductive layer and the frame may be included in the same mold. Other methods of manufacture are contemplated such as, but not limited to, a two-step process performed in a single mold cavity, co-injection molding, or co-extrusion. For example, when manufacturing a wildlife guard having a tube-like configuration as illustrated in FIGS. 6A-8B, below, the conductive layer and the frame may be co-extruded and cut to a desired length.

In other embodiments, the frame, either a wire type frame or thermoplastic frame is provided and the conductive layer is molded on the frame using acceptable molding techniques.

Referring to FIG. 1, the letter G designates generally a substantially circular, flat shaped wildlife guard according to the present invention for installation on electrical power equipment for protection purposes. The guard G is shown in FIG. 1 installed on an insulative bushing B of electrical power equipment E. As will be set forth, the guard G can prevent wildlife from coming into contact simultaneously with both an electrically energized portion of the equipment, such as a bushing terminal or a wire W connecting a bushing terminal to an arrester A, and an electrically grounded area or portion of such equipment or simultaneously contacting two electrical phases.

As can be seen in FIG. 1, the guard G is configured like a substantially circular grid of a size to serve as an outwardly extending barrier so that an animal with one portion of its body, such as feet, paws, tail, etc., on an electrically grounded part of the power distribution network is unable to contact an electrically energized portion of electrical power distribution equipment, such as the wire W connecting bushing B and arrester A without first touching the guard. Guard G can be constructed in a significantly smaller size or diameter wherein the deterrent effect of the guard is attributable more to the discharge of a small electrical charge than to the physical barrier effect.

The bushing B is of the conventional type used in both substation applications and in distribution applications. Examples of distribution applications with bushings where the guard G may be used are on overhead transformers, on capacitors, on line arresters, on or near reclosers, regulators, terminators and the like. Examples of substation equipment with bushings where the guard G may be used include, for example, transformers, circuit breakers, reclosers, sectionalizing switches, terminators, surge arresters and the like. It should be understood that the foregoing examples are given for illustrative purposes and that other applications of the guard G are evident to those in the art. The present invention can also be used on insulators such as post, station post, suspension and pin type insulators.

Figure 2:
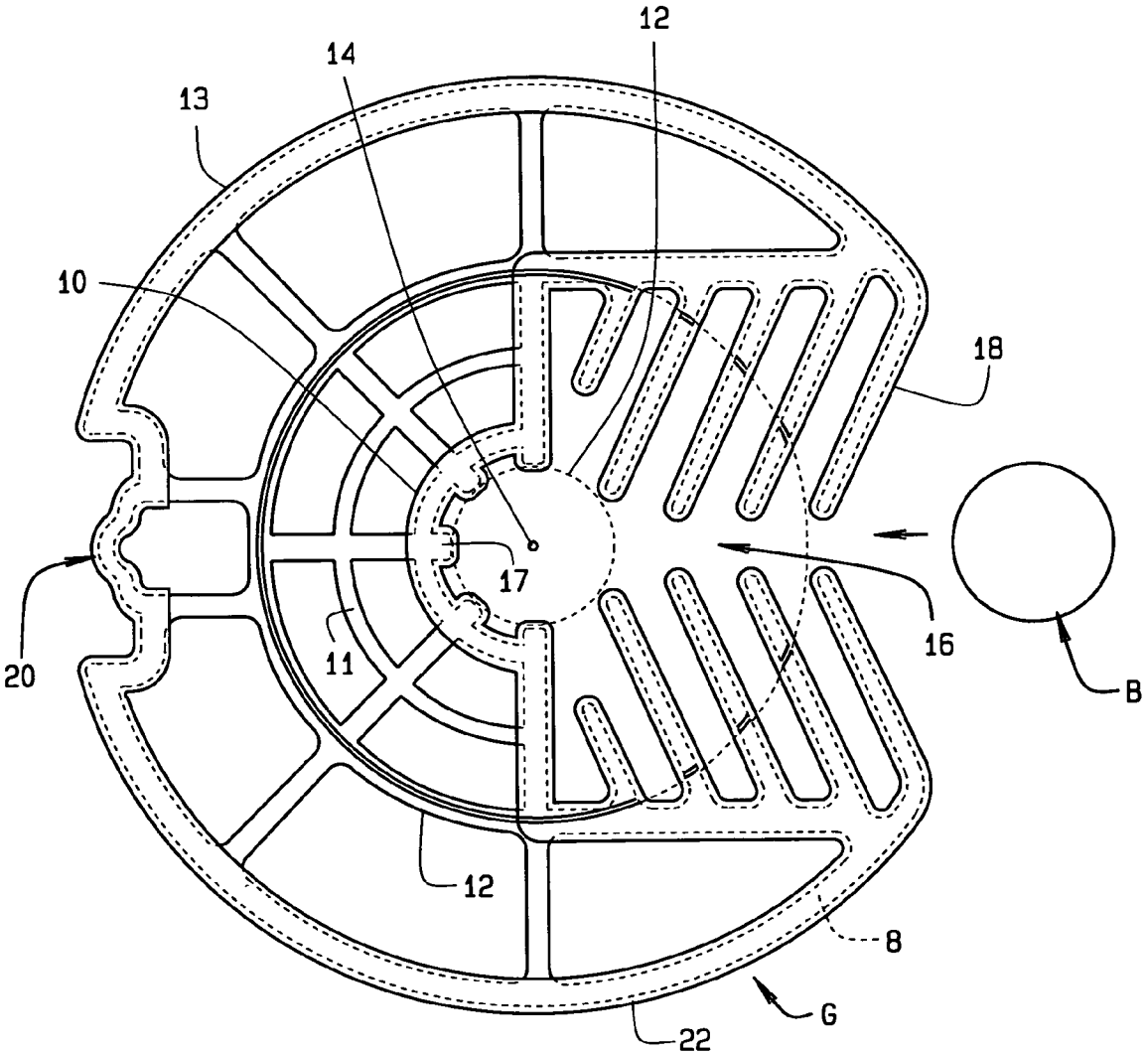
FIG. 2 is a plan view of the wildlife guard of FIG. 1.

Turning now to FIG. 2, the guard G can be referred to has having a generally circular configuration and includes a frame 8 formed of a number of spaced, circular concentric ring members 10, 11, 12 and 13 of increasingly greater diameter disposed outwardly from a central inner opening 14. A mounting slot 16 opens into a central opening 14. There are lugs 17 positioned around central opening that create a space or gap between the bushing and the inner ring 14 when the guard is mounted allowing water to drain from between the guard and the bushing. Mounting slot area includes a plurality of inwardly pointing flexible fingers 18 which flex inwardly to allow mounting of guard G on a bushing and provide lateral stability to the guard during installation. The fingers 18 then create a barrier that blocks dislodgment of guard G from bushing B once guard G is properly positioned on the bushing. However, the fingers do not exert force against the bushing and the bushing is free to rotate or spin on the bushing. This rotational instability provides an additional deterrent to an animal.

The guard G may be configured in any useful configuration. One example is the disc-like guards disclosed in my U.S. Pat. No. 7,075,015, and my U.S. Pat. No. 6,878,883, both of which are incorporated herein by reference. It should also be understood that a guard G of any suitable outside diameter may be employed as required for the electrical power distribution equipment. The guard G may comprise one or more installation grip areas 20 formed at suitable locations of the guard G for attachment of a mounting tool or hot-stick. The illustrated grip area 20 is loop-like. The guard is installed generally as described in the above-referenced patents.

Figure 3:
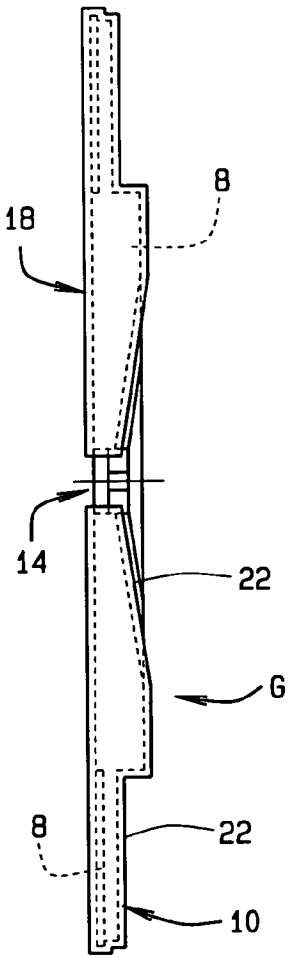
FIG. 3 is a side elevation view of the wildlife guard of FIGS. 1 and 2.
Figure 4:
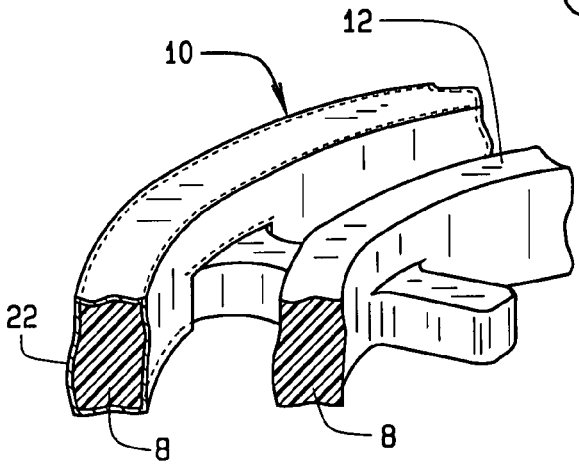
FIG. 4 is an enlarged isometric view of a portion of the wildlife guard of FIG. 2.

In one aspect of the invention frame 8 is formed of a high-strength, durable synthetic resin that is resistant against deterioration from the sun's ultraviolet rays during service use. Most preferably, the material is UL94 compliant for low flammability and is formed by injection or compression molding. In another aspect of the invention, frame 8 can be formed from alternative materials, even conductive material such as metal or wire or the like. As seen in FIGS. 2 through 4, frame 8 has an outer conductive layer 22. The conductive layer 22 is formed from an appropriate primary material, such as thermoplastic resin or elastomer which includes a conductive filler. Conductive layer 22 is molded or otherwise bonded onto to frame 8 in an acceptable manner such as those co-molding or over-molding techniques described above. In the representative embodiment of guard G shown in FIG. 2, the conductive layer 22 extends around the entire outer ring 13, fingers 18 and inner ring 10 to form a continuous conductive layer around guard. Alternatively, the entire surface of frame 8 could be covered with a conductive layer. In other embodiments the conductive layer 22 may be present in discrete conductive segments, as will be explained in regards to the embodiment of FIG. 10.

In any event, it has been determined that the conductive filler distributed in the moldable material forms an array of capacitors. The conductive filler material is preferably stainless steel conductive fibers, copper, aluminum, carbon black or any other conductive material compatible with the broader aspects of the invention known to conduct electricity. When stainless steel fibers are used, the stainless steel fibers preferably comprise less than about 20% by weight of the formulation, more preferably less than about 15% by weight of the composition, more preferably less than about 12% by weight of the composition, more preferably less than about 10% by weight of the composition, more preferably less than about 8% by weight of the composition, and most preferably between about 3% and about 5% of the composition. When copper is used the conductive material can comprise between about 3% and about 20% by weight of the formulation. Similarly when aluminum or carbon black is used material can comprise between about 3% and about 20% by weight of the formulation. The amount of conductive material may be adjusted if the underlying frame is formed from a conductive material, such as wire. In any event, the conductive material is infused in or mixed with the primary material used to form the conductive layer 22.

It will be appreciated that, although preferred percentages of conductive filler are set out above for illustrative purposes, the invention contemplates a conductive layer that includes any percentage or appropriate amount of conductive filler that provides the desired results described herein.

The conductive material within the moldable formulation comprising the conductive layer 22 is capable of attaining a small electrostatic charge from the electrostatic field surrounding, or adjacent to the electrically energized components of the device being protected. When touched by an animal, the charge dissipates to ground or across the device (e.g. a squirrel touching the device) through the animal but is a small enough charge that the shock received by the animal serves only as a deterrent to climbing on the electrical device and does not injure the animal at all. It is believed that over time the shock will condition the animal to avoid the shock, and therefore the wildlife guard, completely. As a result, the conductive fibers within the conductive layer provide a deterrent to wildlife, preventing them from climbing on electrical equipment protected by the guard.

Figure 5A:
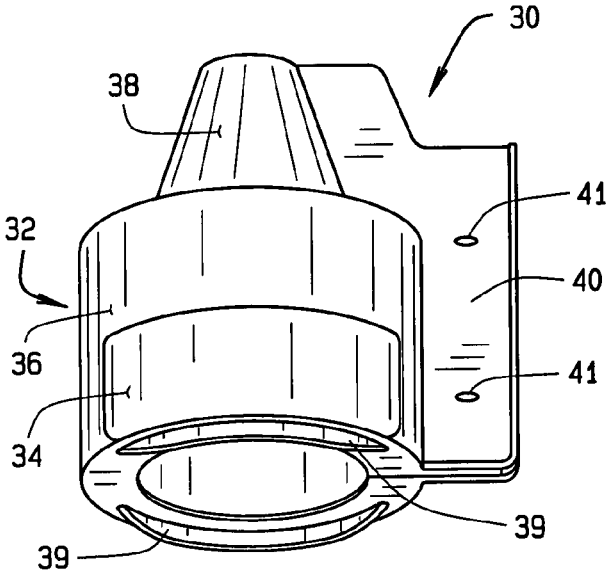
FIG. 5A is a bottom perspective view of the wildlife guard of FIG. 5.
Figure 5:
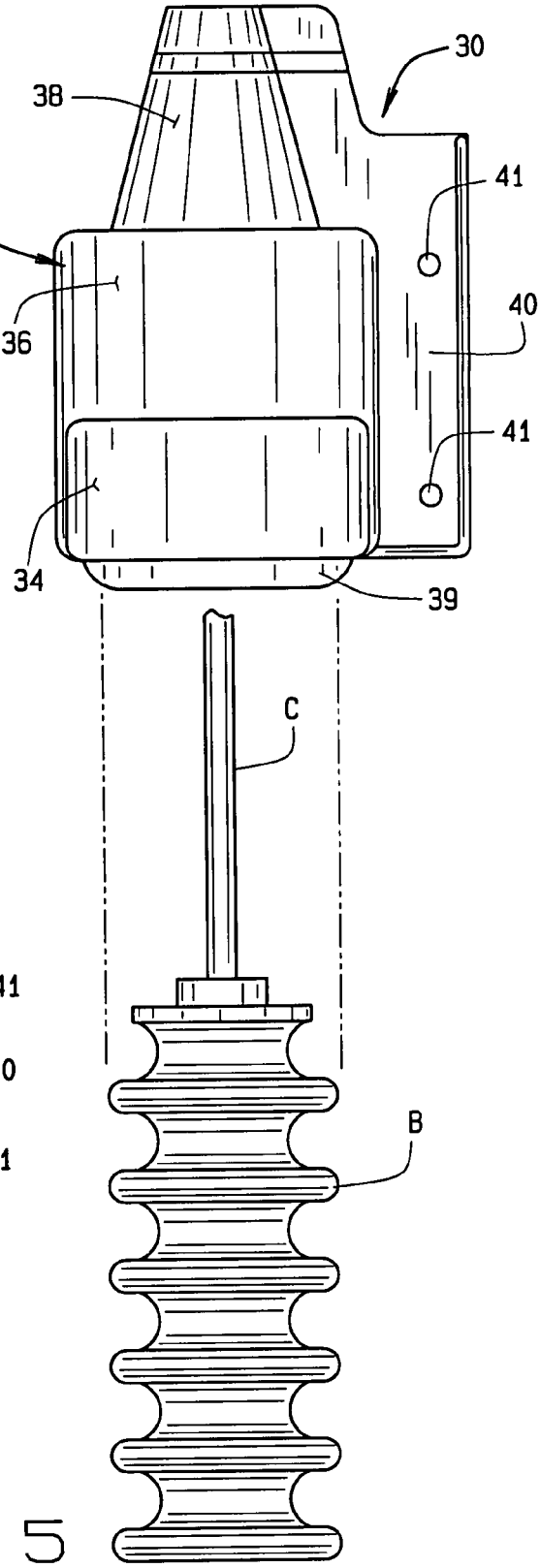
FIG. 5 is an isometric view of another embodiment of a wildlife guard of the present invention in position for mounting on an insulating bushing.

In another embodiment and referring to FIGS. 5 and 5A, the wildlife guard of the present invention is configured as a cover 30 for an electrical insulator bushing B having an electrical conductor C extending therefrom. The cover 30 comprises a jacket 32 and electrostatic or conductive layer 34, generally referred to as a panel, on the cover 30, as will be described in greater detail below. The jacket 32 defines a hollow cylindrical body portion 36 and a frusto-conically-shaped top portion 38 leaving a circular opening at the top for entry of the conductor C. There are semi-circular supports 39 on the bottom of the cylindrical body portion 36. The jacket 32 also defines a pair of opposed flanges 40 that can be separated by resiliently flexing the jacket 32 The flanges 40 may be attached to one another with fasteners through holes 41 after the jacket 32 has been placed in service over the bushing B so as to maintain the cover 30 in position.

Jacket 32 may be constructed from a non-conductive material, such as a thermoplastic resin, a rubber or rubberized polymer or thermoplastic that allows some deformation of the jacket for mounting. The jacket is constructed to allow separation at the flange 40 sufficient to provide clearance for the conductor to be at least partially encased within the hollow cylindrical portion and returnable to its initial position to capture the conductor within the hollow cylindrical portion. The jacket can be deformable to allow opening or constructed in two sections connected by a hinge structure, or two separate sections connected by fasteners of some sort to allow separation for mounting. When placed on bushing B the wildlife guard may rest on supports 39 to elevate body portion 36 and the electrostatic panels 34 above the bushing B to keep the panels 34 from contacting the bushing. However, body 36 without supports 39 is acceptable, for example, where the conductive layer or panel 34 is positioned on the body to avoid contact with conductive elements.

Attached to the jacket 32, and most preferably the body portion 36, are electrostatic panels 34. The electrostatic panels 34 are made from an appropriate primary material, such as elastomer, with a conductive filler, as explained above. In general, conductive panels 34 are molded onto the jacket through an over-molding process, generally in a cavity mold. However, the panel could be molded separately and attached by any means such as fasteners, adhesive, such as glue or peel-off backing, or be in the form of a rubberized or silicone tape material applied to the cover. Thus the panels can be retrofitted to existing guard which may or may not have supports. In any event, the illustrated conductive panels 34 have a generally rectangular configuration, but can have any desired configuration or geometry and could extend completely around the body portion 36. Cover 30 may include one panel or any number of panels. In the illustrated embodiment, panels 34 are positioned near the bottom of body 36.

The panels 34 gain an electrostatic charge from the electrostatic field transmitted through the air from the conductor C or from any closely situated electric field of sufficient magnitude to charge the panel. When an animal climbing on electrical equipment incorporating the cover 30 and comes into contact with one of the panels 34, the animal receives a small shock and is deterred from further climbing on the electrical equipment. The shock is not harmful to the animal, but is of a level that is an annoyance to the animal. It is believed that the receipt of the shock by the animal creates a conditioned response in the animal that further prevents the animal from climbing on the equipment. As a result, the present invention saves the cost associated power failures and avoids the unnecessary death of wildlife.

Figure 6A:
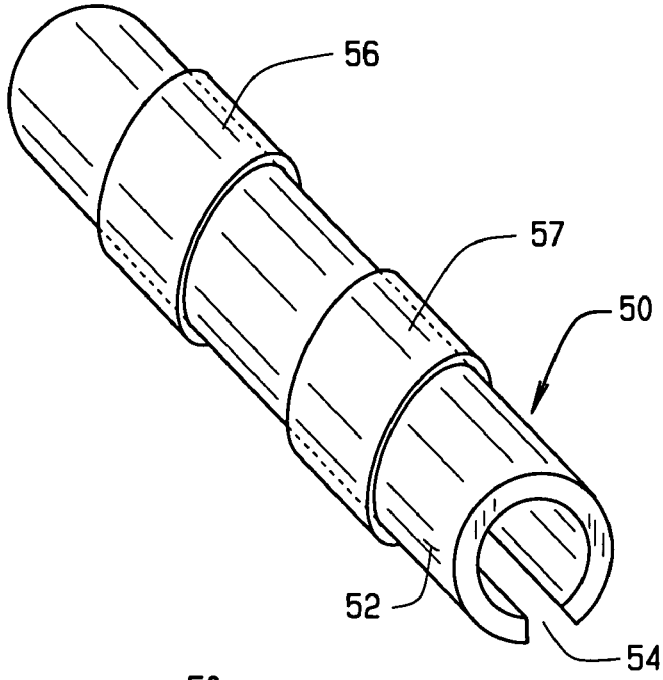
FIG. 6A is a perspective view of another embodiment of a wildlife guard of the present invention.
Figure 6B:
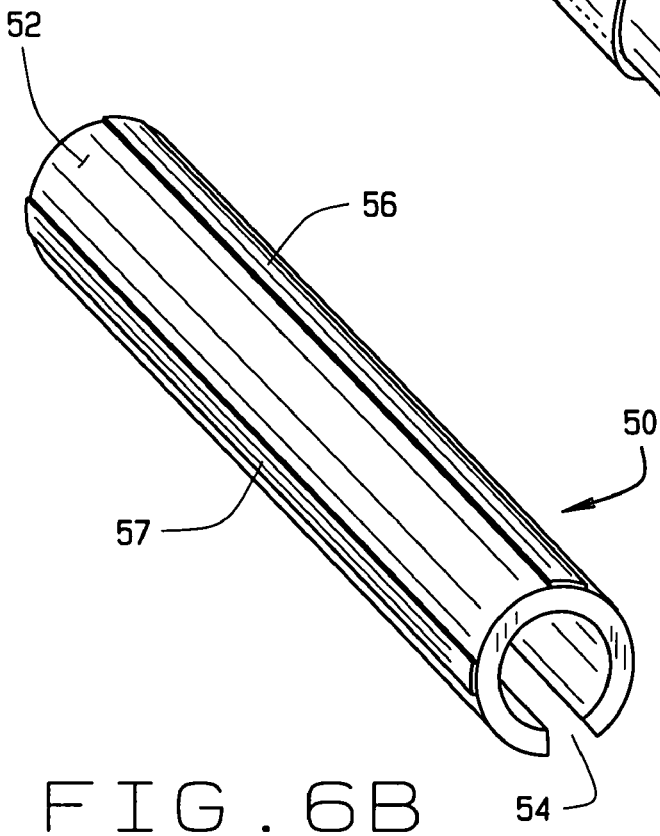
FIG. 6B is a perspective view of another embodiment of the wildlife guard of FIG. 6A.
Figure 7:
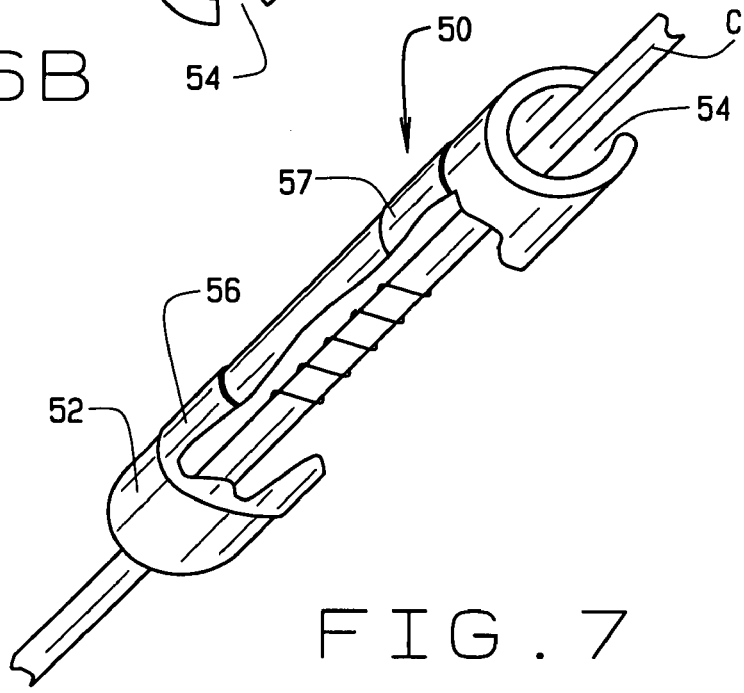
FIG. 7 is another perspective view of a wildlife guard of FIG. 6 attached to an electrical wire.

Referring to FIGS. 6A to 7, another embodiment of a wildlife guard present invention indicated generally by reference number 50, is configured for placing upon a shielded conductor C. The guard 50 comprises frame or body, which in this embodiment is a hollow cylindrical body 52 defining a longitudinal slit 54. The hollow cylindrical body 52 generally is formed from a nonconductive material, such as a thermoplastic resin, rubber or other polymer. In general body 52 can be formed through extrusion molding in any desired length or cut to a desired length. Body 52 generally is resilient so that it can be opened along slit 54, placed around a conductor C and then close to keep it in place. Guard 50 includes outer conductive layers 56 and 57. In the illustrated embodiment of FIG. 6A, conductive layers 56 and 57 extend circumferentially around body 52. In FIG. 6B, conductive layers 56 and 57 extend longitudinally along body 52. In any event the conductive layers are found in discrete segments with sections of non-conductive material positioned between the segments of conductive layer.

The segments of non-conductive material can be exposed segments of non-conductive body 52 or layers of non-conductive material bonded on the body. Hence, the segments of conductive layer are not in electrical contact with each other and an electrical charge could not travel the length of guard 50 if the guard inadvertently contacts a live wire and ground at the same time, providing an important safety feature. Wildlife guard 50 may include any number of conductive layers 56 and 57 as required, depending upon its length. Generally they should be close enough together that an animal engaging wildlife guard 50 would touch at least two conductive layers at the same time. Of course, the conductive layer could be one continuous layer along the length of the body, if so desired.

In general, conductive layers 56 and 57 comprise a primary material and a conductive filler, as previously described. The conductive layer can be over-molded on the cylindrical body using an acceptable molding technique, such as co-extrusion. For example, wildlife guard illustrated in FIG. 6B would be particularly conducive to co-extrusion molding. However, any molding or other technique that bonds the conductive layer to the cylindrical body is acceptable. For example, the conductive layers could be molded separately and attached to the body. In any event, it will be appreciated that adjacent conductive layers such as layers 56 and 57 would each have different conductive filler content or different masses so as to create a potential (voltage) difference between the two. If two conductive layers had the same electrostatic charge an animal touching both conductive layers at the same time would not be shocked.

Figure 8A:
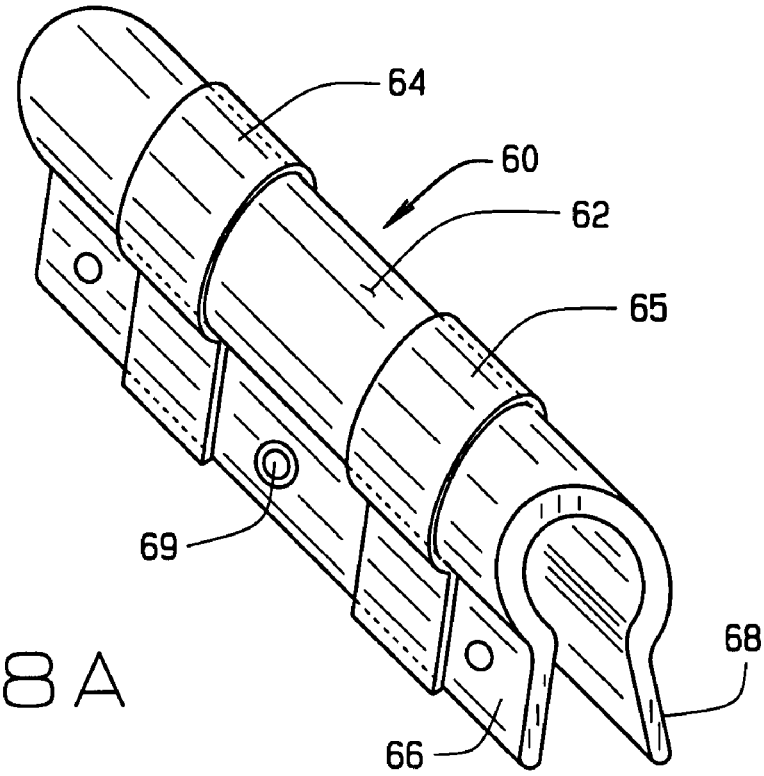
FIG. 8A is a perspective view of another embodiment of a wildlife guard of the present invention.
Figure 8B:
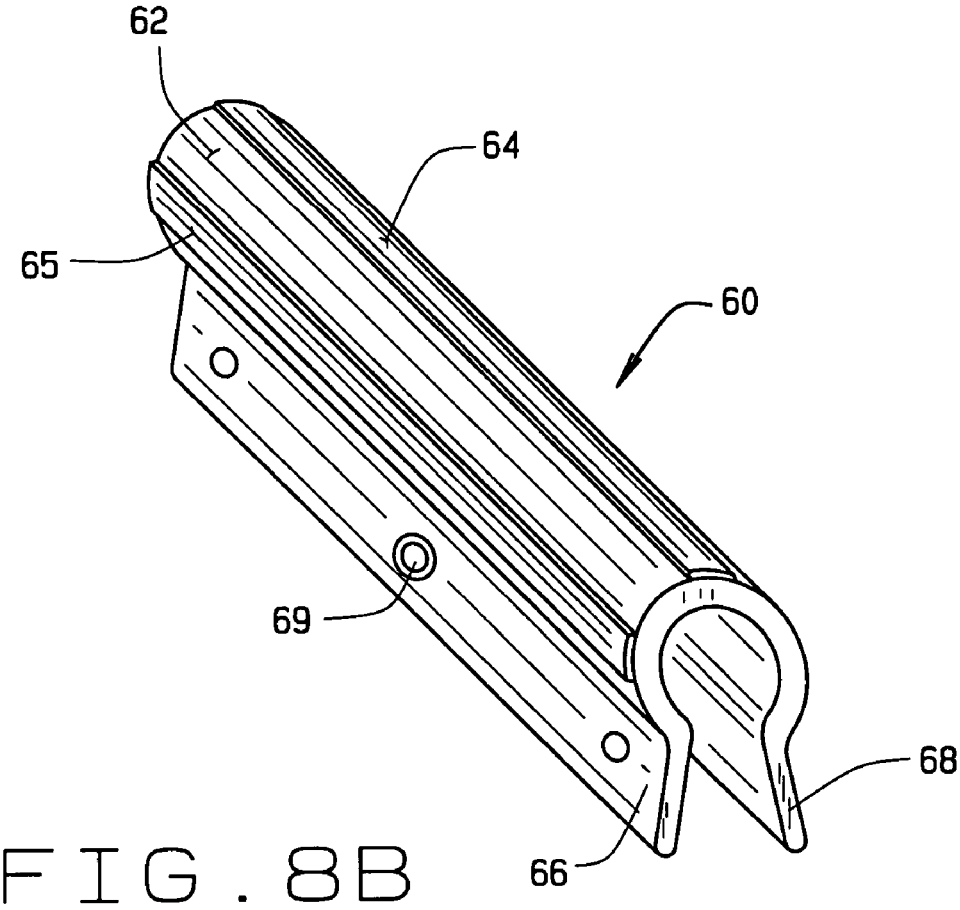
FIG. 8B is another embodiment of the wildlife guard of FIG. 8A.

FIGS. 8A and 8B show a variation of the guard of FIGS. 6A to 7, referred to generally as guard 60. Guard 60 includes a substantially cylindrical, non-conductive body 62 and conductive layers 64 and 65 provided as discrete conductive areas separated by insulating material. In the embodiment of FIG. 8A, conductive layers extend substantially circumferentially around body 62. The embodiment of FIG. 8B includes conductive layers 64 and 65 extending longitudinally along body 62. In either embodiment, guard 60 is shown having flanges 66, 68 attached thereto. The flanges 66 and 68 may include openings or holes 69 through which fasteners may be used to attach the flanges 66 and 68, to one another to keep guard 60 in place. Adjacent conductive layers 64 should have different conductive filler content or different mass so as to create a voltage potential.

Although guards 50 and 60 are described as having non-conductive bodies, under appropriate circumstances the bodies may be formed from a material having some conductive properties. In those embodiments, the guard would be placed on an insulated or uninsulated, but non-shielded conductor.

Figure 10:
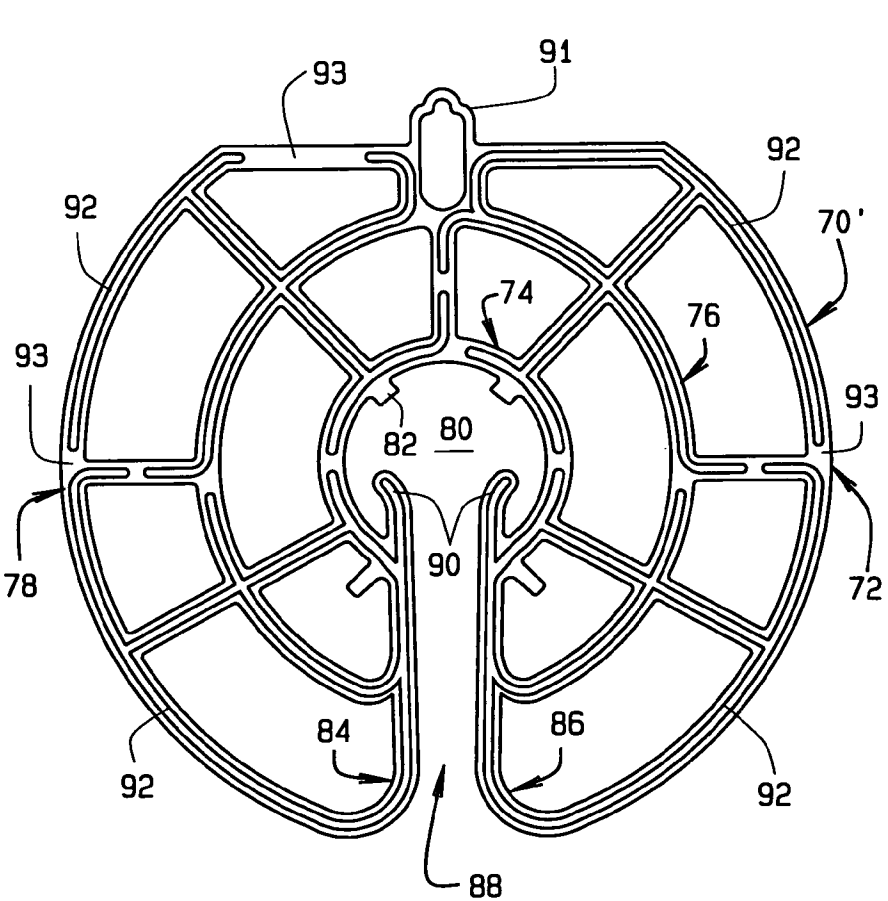
FIG. 10 is a plan view of another embodiment of a wildlife guard of the present invention.
Figure 9:
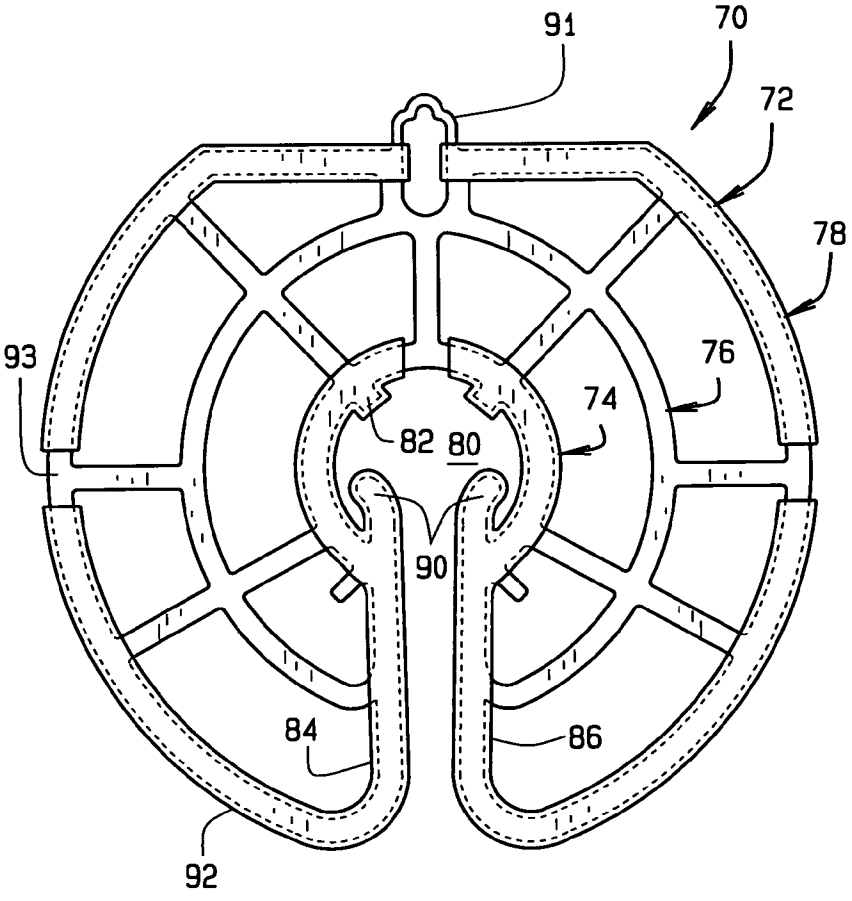
FIG. 9 is a plan view of another embodiment of a wildlife guard of the present invention.

FIGS. 9 and 10 illustrate additional embodiments of guards of the present invention, indicated generally by reference numerals 70 and 70', respectively. Guards 70 and 70' have a general disc-like configuration comprising a frame 72 having concentric circular members 74, 76 and 78 There is a central opening 80 defined by inner circular member 74. It will be appreciated that there is at least one lug 82 on the inner circular member to aid in positioning and to allow for drainage, as described above in reference to guard G. Guards 70 and 70' include an opposed pair of guide members 84 and 86 that define a mounting slot 88. Guide members 84 and 86 extend into open 80 terminating in restraints 90 that resist dislodgment of the guard when it is mounted on a bushing. Guards 70 and 70' have at least one hot-stick attachment structure 91 and are mounted in a manner similar to that of guard G, above. In the illustrated embodiment, the attachment structure is a loop-like attachment structure.

Guards 70, 70' includes a conductive layer 92 molded on frame 72. The frame can be constructed from molded thermoplastic material or an alternate material, such as a conductive material like metal or wire or the like. In general, guard 70 of FIG. 9 illustrates a conductive layer that substantially encompasses the frame elements. Guard 70' (FIG. 10) shows a conductive layer applied to the top surface of the frame elements, which requires less conductive material and may be more cost effective. The conductive layer may be present on any selected exposed surface of the frame. In any event, conductive layer 92 can form a continuous conductive layer on the entire guard frame 72 or around only the perimeter of the guard (See, e.g. FIG. 2).

Alternatively, the conductive layer can comprise discrete conductive layers 92 positioned around the frame as shown in the drawings. In general, where the conductive layer comprises discrete conductive layers, the frame is constructed from a non-conductive material to avoid forming an electrical connection between the discrete conductive layers. There are sections 93 of non-conductive material, such as exposed frame or other non-conductive material between the segments of conductive layer at various places around the frame so that the segments of conductive layer are not in electrical contact with each other. Hence, if guard 70, 70' contacts an energized electrical conductor and ground simultaneously, electricity will not be conducted through the entire guard. Adjacent conductive layers 92' could have different conductive filler content or different mass so as to create a voltage potential.

Figure 11:
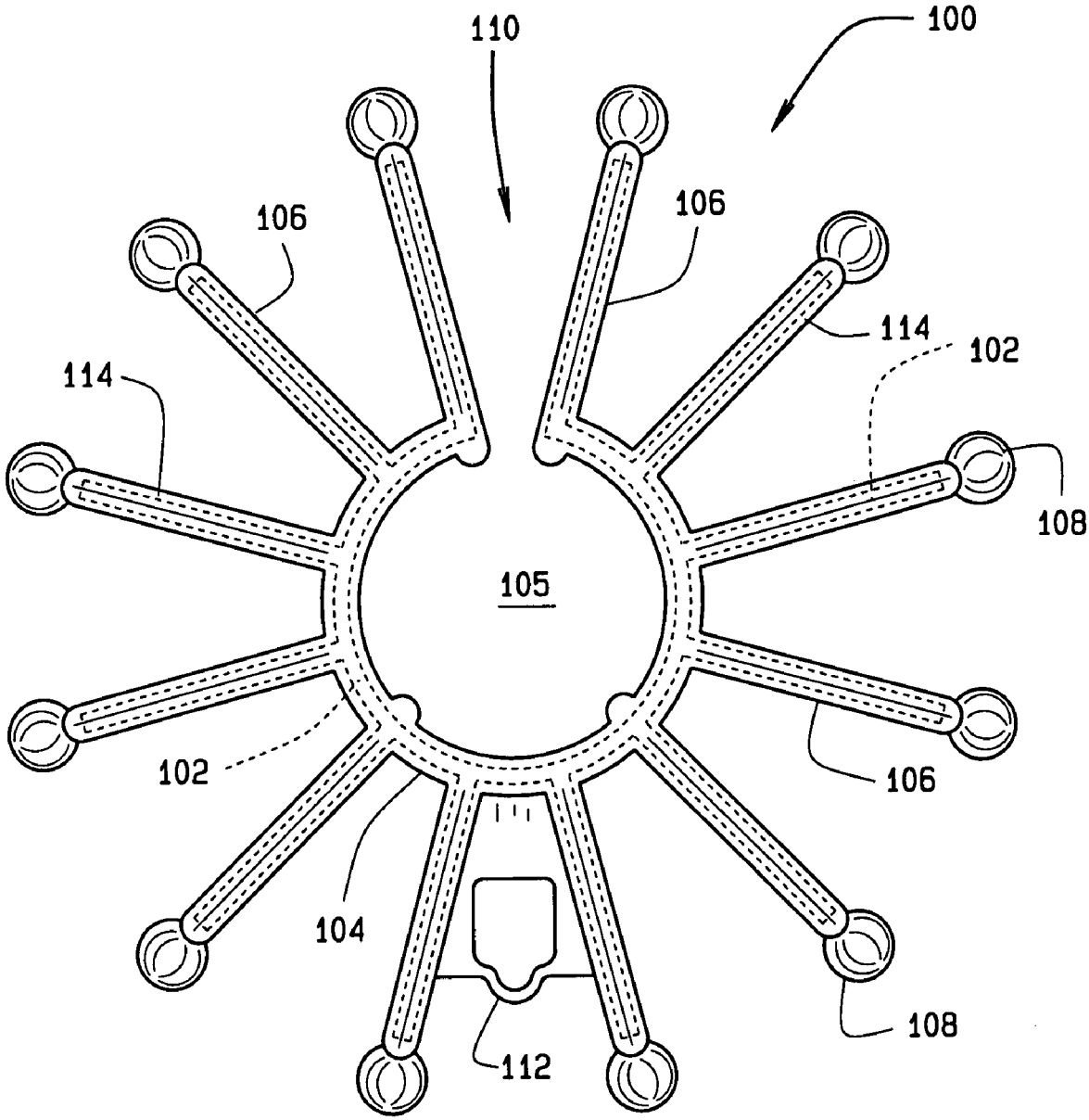
FIG. 11 is a plan view of another embodiment of a wildlife guard of the present invention.

FIG. 11 illustrates another embodiment of a wildlife guard of the present invention indicated generally by reference numeral 100. Wildlife guard 100 has a body or frame 102 comprised of a substantially circular central frame member 104 defining a central, substantially circular opening 105. An array of radial spokes 106 projects outwardly from central frame member 104. The spokes 106 have generally spherical diffusers 108 at the terminal ends. The spokes can extend outwardly in the same plane as the central frame member or can be bent downwardly so that leaves and other debris are less likely to accumulate on the spokes. There is a mounting slot 110 on one side of guard and an installation grip area 112, for example a loop-like installation grip as shown, for attachment of hot-stick at the opposite side. Frame 102 can be constructed from a resilient, non-conductive material, such as a plastic, that allows the frame to open sufficiently at the mounting slot 110 for attachment around a bushing.

Alternatively, frame 102 can be formed from another material, for example metal, wire or the like. When comprising a pliable material, such as a wire frame 102, components of the frame may be bendable. For example, spokes 106 can be bent downwardly to prevent a buildup of leaves or other debris on the spokes.

There is an electrically conductive layer 114 molded on the frame, using appropriate molding techniques. In the illustrated embodiment of wildlife guard 100, the electrically conductive layer 114 is present on the central member 104 and the spokes 106, including the terminal diffusers 108. As previously described in regards to other embodiments, conductive layer 114 may encompass the frame elements, may be present on any exposed surface of the frame elements or may be present in discrete sections of different mass or conductive filler content. Generally, if the conductive layer is provided in discrete segments, frame 102 would be constructed from a non-conductive material. As should be understood, any pattern of conductive layer that provides for sufficient buildup of static charge is within the scope of the invention. In general, the spherical shape of the diffusers prevents the concentration of electricity that can occur with a pointed or angular structure, but these are not required for the invention to work.

Figure 12:
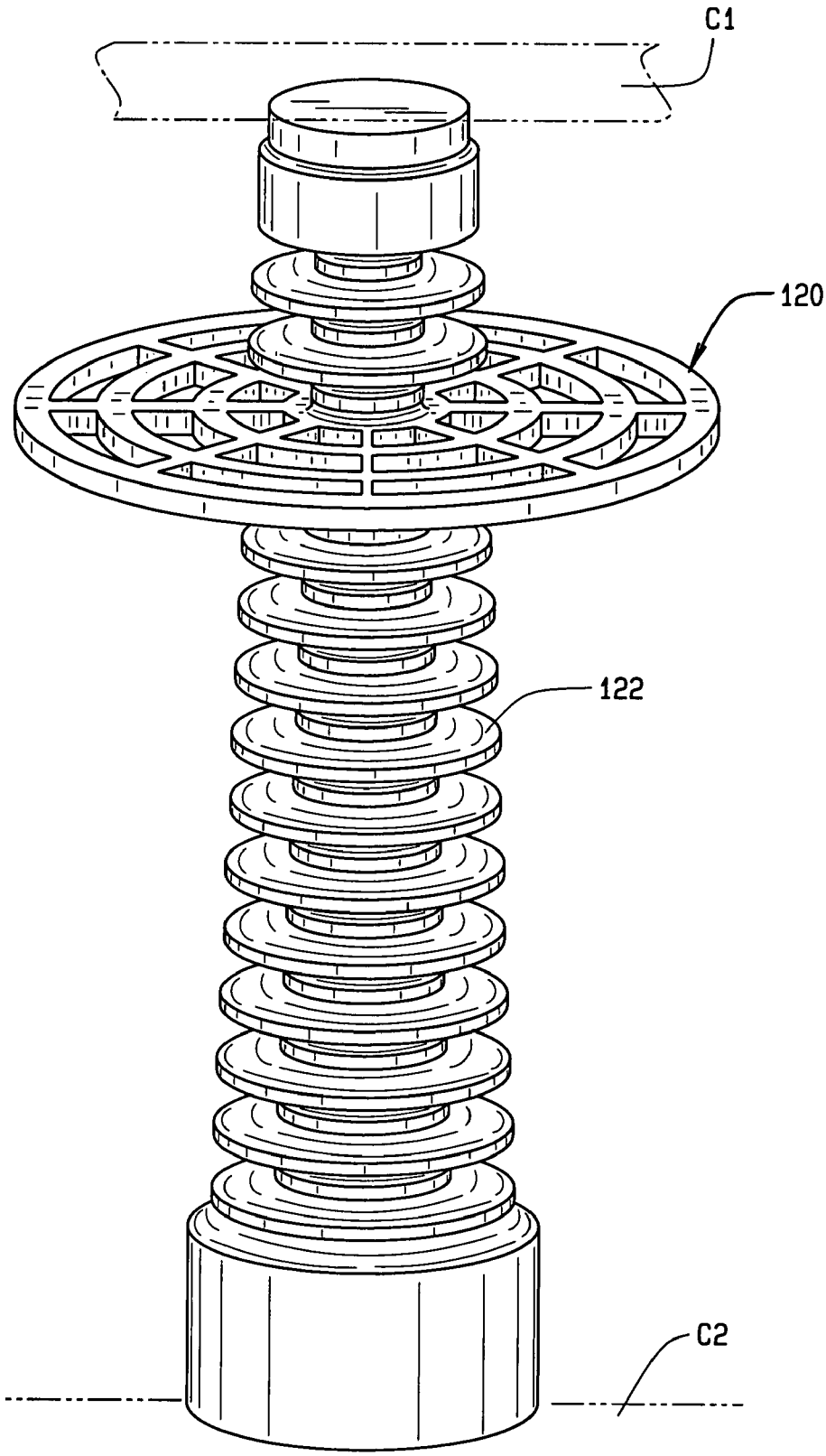
FIG. 12 is front elevational view of a post insulator including a molded wildlife guard of the present invention.

FIG. 12 illustrates another embodiment of a wildlife guard of the present invention. In this representative embodiment, a wildlife guard 120 is attached to an insulating device 122 used with electrical equipment. In FIG. 12, the insulating device is a post insulator and is representative of numerous other insulating devices. It will be appreciated by those skilled in the art that insulating device 122 can be any one of a number of insulating devices for use with electrical equipment including, but not limited to, suspension insulators, surge arrestor insulators, recloser bushings, transformer bushings, sectionalizing switch insulators, post insulators, pin insulators, terminator insulators or the like.

Insulating device 122 is formed from a non-conductive material such as epoxy, thermoplastic resin, porcelain, and so forth. Wildlife guard 120 can be molded to the insulating device using the materials and molding techniques previously described. If desired, the entire assembly, i.e. insulating device 122 and wildlife guard 120 could be molded as one piece, with the wildlife guard 120 including conductive filler. On the other hand, the insulating device 122 can be molded as one piece with a conductive wildlife guard 120 over-molded onto insulating device 122. The conductive wildlife guard can be contiguous, in segments or comprise attached conductive panels, similar to those described above in reference to FIG. 5.

In other embodiments, the wildlife guard 120 could be molded separately from the insulating device 122 and affixed to the insulating device in any acceptable manner.

In the illustrated embodiment, wildlife guard 120 is substantially circular in peripheral configuration and extends radially out from the insulating device 122 and is positioned on the insulating device at a location which could impede an animal from touching conductive elements C1, C2 and positioned so that an animal accessing the insulating device would likely touch the wildlife guard 120 and be deterred by a shock. To that end, wildlife guard can be constructed having any geometric configuration, such as circular, rectangular, triangular, octagonal, conical and so forth. It can be constructed as a flat plate, frame, grid or other desirable construction. It can comprise only spokes or the like extending radially from the insulating device. The wildlife guard can extend out from the insulating device in a horizontal plane or be configured to angle downwardly to help eliminate buildup of debris on the guard.

Figure 13:
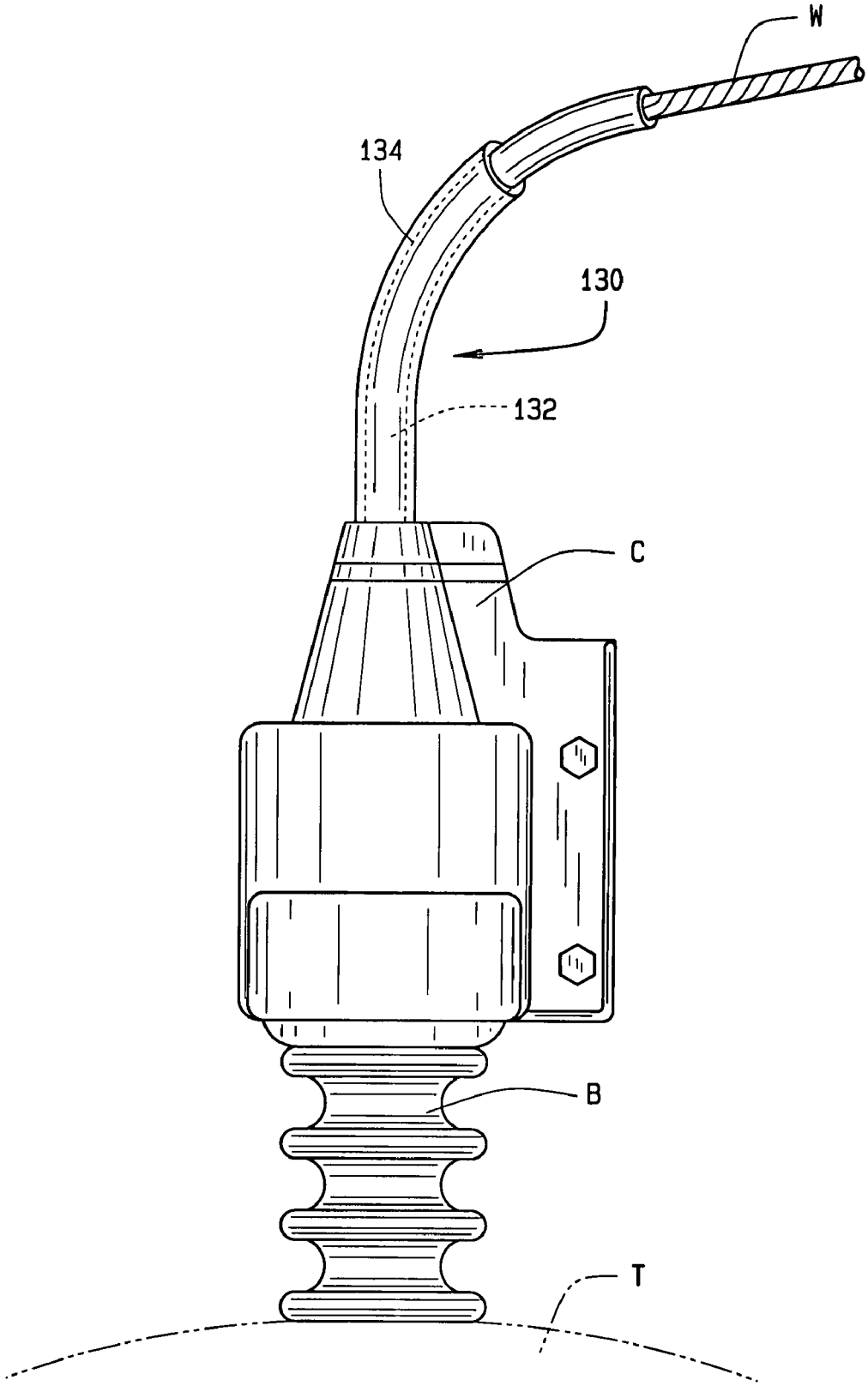
FIG. 13 is a front elevational view of another embodiment of a wildlife guard of the present invention mounted on a conductive wire

FIG. 13 illustrates another wildlife guard of the present invention, indicated generally by reference number 130. Guard 130 is shown attached to a conductive wire W or stinger exiting bushing B on top of a grounded transformer tank T. There is a bushing cover C interposed between guard 130 and transformer T. Guard 130 is substantially tubular having an elongated tubular body 132. Guard 130 can be constructed similarly to guards 50 and 60, described above, or body 132 can be a solid insulated tube, as shown. Guard 130 has a conductive layer 134, which can completely cover body 132 or be placed in discrete segments. In this embodiment and environment, the discrete segments can have the same potential since the current path to deter the animal would run from the guard 130 through an animal to a grounded structure such as transformer tank T.

The wildlife guards of the present invention apply to a wide variety, if not all, insulator materials. Further, although the alternative embodiments show the wildlife guards of the present invention for use in protecting bushings, arresters, insulators, and terminators, the present invention contemplates that other power devices having energized and grounded surfaces or surfaces of different electrical potential may also be protected from wildlife.

Certain of the embodiments of the wildlife guard of the present invention lend them selves to attachment or installation by use of a device such as a hot-stick, it will be appreciated that any of the devices described herein may be attached to electrical equipment by hand using insulated gloves, for example, or by any other safe and effective way of mounting the devices.

While the specific embodiments have been described, numerous modifications come to mind without significantly departing from the spirit of the invention, and the specification and accompany drawings should not be construed so as to narrow the scope of protection and the accompanying claims.

The invention claimed is:

1. A wildlife guard for an electrical insulator bushing, the wildlife guard comprising:

a frame constructed for mounting on the electrical insulator bushing; and an electrically conductive outer layer bonded to a surface of said frame, said electrically conductive outer layer comprising a moldable, non-conductive material with electrically conductive material dispersed throughout the non-conductive material.

2. The wildlife guard of claim 1 wherein said electrically conductive layer comprises at least one discrete segment of electrically conductive layer bonded on the surface of said frame with at least one segment of nonconductive material adjacent said at least one discrete segment of electrically conductive layer.

3. The wildlife guard of claim 2 wherein said electrically conductive layer comprises at least two discrete segments of electrically conductive layer with a segment of nonconductive material between the at least two discrete segments of electrically conductive layer so that the at least two segments of electrically conductive layer are not in electrical contact with each other.

4. The wildlife guard of claim 1 wherein said electrically conductive layer is over molded on the frame.

5. The wildlife guard of claim 1 wherein the frame is constructed from a nonconductive material.

6. The wildlife guard of claim 1 wherein the frame is constructed from a conductive material.

7. The wildlife guard of claim 1 wherein the frame is adapted for attachment to a separate insulating device used in the electrical distribution industry.

8. The wildlife guard of claim 1 where in the frame further comprises an elongated tubular body defining at least one slit and having at least two end portions that meet along the slit wherein the tubular body is separated at the two end portions to provide clearance for a conductor to be at least partially encased within the hollow cylindrical portion; and wherein the tubular body has a nonconductive layer and at least one conductive outer layer bonded to a surface of the tubular body, the conductive outer layer comprising a moldable, non-conductive material with a conductive filler dispersed throughout the non-conductive material wherein said conductive outer layer maintains a static charge thereon to provide a shock to any wildlife which come into contact with the conductive layer.

9. The wildlife guard of claim 8 wherein said conductive filler is selected from a group of conductive fillers consisting of stainless steel, copper, aluminum and carbon black and combinations of stainless steel, copper, aluminum and carbon black.

10. The wildlife guard of claim 8 wherein said conductive outer layer is divided into discrete segments having segments of non-conductive material positioned between said discrete segments of conductive outer layer so that the discrete segments of conductive outer layer are not in electrical contact with each other.

11. The wildlife guard of claim 8 wherein the tubular body has two flanges attached adjacent the end portions of the slit.

12. The wildlife guard of claim 8 wherein the tubular body partially encases the conductor and is held to the conductor with fasteners.

13. The wildlife guard of claim 1 wherein the frame further comprises a frusto-conical portion and at least one electrically conductive layer bonded to a surface thereof, said electrically conductive layer comprising a dielectric material having a conductive filler dispersed throughout the dielectric material in a quantity sufficient to form an array of capacitors such that the conductive layer maintains an electrostatic charge when placed on electrical equipment, said wildlife guard further comprising a support structure under the frusto-conical portion to engage the bushing and separate the at least one conductive layer from the bushing.

14. The wildlife guard of claim 1 wherein said electrically conductive layer comprises at least one discrete segment of electrically conductive layer having a first electrical potential bonded on the surface of said frame adjacent an area of the frame having a second electrical potential different from the first electrical potential.

15. The wildlife guard of claim 1 wherein said moldable, non-conductive material is selected from a group of moldable non-conductive materials consisting of thermoplastic resin, thermosetting resin, thermoplastic polymers, rubber, and fiberglass.

16. A wildlife guard comprising:

a body comprised of a non-conductive material having a layer of electrically conductive material bonded to a surface thereof, said layer of electrically conductive material comprising a moldable dielectric material with an electrically conductive filler dispersed throughout the dielectric material in a quantity sufficient to form an array of capacitors on the body such that the electrically conductive layer maintains an electrostatic charge when placed on electrical equipment.

17. The wildlife guard of claim 16 wherein the electrically conductive filler is comprises stainless steel fibers.

18. The wildlife guard of claim 16 wherein the conductive material comprises carbon black.

19. The wildlife guard of claim 16 wherein the conductive material comprises copper.

20. The wildlife guard of claim 16 wherein the conductive material comprises aluminum.

21. The wildlife guard of claim 16 wherein the body of the guard has a generally circular configuration.

22. The wildlife guard of claim 21 further comprising at least one substantially circular member, a central opening and a pair of opposed guide members defining a mounting slot extending into said central opening.

23. The wildlife guard of claim 22 wherein each of the opposed guide members has a terminal end that extends into said central opening, said terminal end including a restraint structure.

24. The wildlife guard of claim 16 wherein the body of the guard has an elongated tubular configuration.

25. The wildlife guard of claim 16 wherein the body further comprises a mounting tool engagement structure.

26. The wildlife guard of claim 25 wherein the mounting tool engagement structure is a loop.

27. The wildlife guard of claim 16 wherein the body of the guard comprises a substantially circular central member with a plurality of spokes extending radially therefrom.

28. The wildlife guard of claim 27 wherein said spokes have a substantially spherical diffuser at a terminal end.

29. The wildlife guard of claim 16 wherein the body is ultraviolet energy resistant.

30. A wildlife guard comprising:

a frame; and an electrically conductive layer bonded on a surface of the frame, said conductive layer comprising a moldable dielectric material having a conductive filler dispersed throughout the dielectric material in a quantity sufficient to form an array of capacitors such that the electrically conductive layer maintains an electrostatic charge when placed on electrical equipment.

31. The wildlife guard of claim 30 wherein said frame comprises a non-conductive material.

32. The wildlife guard of claim 30 wherein said frame comprises a conductive material.

33. The wildlife guard of claim 30 wherein the electrically conductive filler comprises stainless steel fibers.

34. The wildlife guard of claim 30 wherein the conductive material comprises carbon black.

35. The wildlife guard of claim 30 wherein the conductive material comprises copper.

36. The wildlife guard of claim 30 wherein the conductive material comprises aluminum.

37. The wildlife guard of claim 30 wherein the body of the guard has a substantially circular configuration.

38. The wildlife guard of claim 37 wherein the body of the guard comprises a substantially circular central member with a plurality of spokes extending radially therefrom.

39. The wildlife guard of claim 38 wherein said spokes have a substantially spherical diffuser at a terminal end.

40. The wildlife guard of claim 38 wherein said spokes are bendable.

41. The wildlife guard of claim 37 further comprising at least one substantially circular member, a central opening and a pair of opposed guide members defining a mounting slot extending into said central opening.

42. The wildlife guard of claim 41 wherein each of the opposed guide members has a terminal end that extends into said central opening, said terminal end including a restraint structure.

43. The wildlife guard of claim 30 wherein said electrically conductive layer comprises at least one discrete electrically conductive layer.

44. The wildlife guard of claim 30 wherein the body further comprises a mounting tool engagement structure.

45. The wildlife guard of claim 44 wherein the mounting tool engagement structure is a loop.

46. A combination insulating element and wildlife guard for use with electrical equipment, comprising:

an insulating body comprised of a non-conductive material and an animal guard thereon, wherein at least said animal guard comprises a dielectric material with a conductive filler material dispersed throughout the dielectric material in quantity sufficient maintain an electrostatic charge when the combination insulating element and wildlife guard is placed on the electrical equipment.

47. The combination insulating element and wildlife guard of claim 46 wherein the insulating element is selected from a group of insulating elements consisting of suspension insulators, surge arrestor insulators, transformer bushings, recloser bushings, sectionalizing switch insulators, post insulators, pin insulators, terminator insulators.

48. The combination insulating element and wildlife guard of claim 46 wherein the animal guard is molded on the insulating element.

49. The combination insulating element and wildlife guard of claim 46 wherein the animal guard is retrofitted to the insulating body.

50. The combination insulating element and wildlife guard of claim 46 wherein the animal guard extends radially from the insulating body.

51. A method of deterring an animal from climbing on electrical equipment comprising:

placing a guard on the electrical equipment and positioning the guard for contact by an animal attempting to climb on the electrical equipment, the guard comprising a frame with a conductive layer bonded to at least one surface of the guard, said conductive layer comprising a moldable dielectric material with a conductive filler material dispersed throughout the dielectric material in quantity sufficient for the conductive layer to maintain an electrostatic charge when placed on the electrical equipment, whereby the electrostatic charge provides an annoying shock to the animal when it contacts the conductive layer of the guard, thereby deterring the animal from climbing on the electrical equipment.

52. The method of claim 51 wherein the step of placing and positioning the guard further comprises placing and positioning the guard with a hot stick apparatus.

53. The method of claim 51 wherein the step of placing and positioning the guard further comprises placing and positioning the guard with electrically insulated gloves.

54. The method of claim 51 wherein the step of placing and positioning the guard further comprises placing and positioning the guard over a bushing.

* * * * *